US009039586B2

(12) United States Patent
Januszek

(10) Patent No.: US 9,039,586 B2
(45) Date of Patent: May 26, 2015

(54) EXERCISE DEVICE FOR WEIGHTLIFTING AND OTHER FITNESS ACTIVITIES

(75) Inventor: Matthew Lee Januszek, Peterborough (GB)

(73) Assignee: Escape Fitness Limited, Cambridgeshire (GB)

( * ) Notice: Subject to any disclaimer, the term of this patent is extended or adjusted under 35 U.S.C. 154(b) by 215 days.

(21) Appl. No.: 13/343,273

(22) Filed: Jan. 4, 2012

(65) Prior Publication Data

US 2012/0178597 A1 Jul. 12, 2012

(30) Foreign Application Priority Data

Jan. 5, 2011 (GB) ..... 1100066.8

(51) Int. Cl.
*A63B 21/072* (2006.01)
*A63B 71/00* (2006.01)

(52) U.S. Cl.
CPC ..... *A63B 21/0724* (2013.01); *A63B 21/0726* (2013.01); *A63B 71/00* (2013.01); *A63B 2071/0063* (2013.01)

(58) Field of Classification Search
USPC ..... 482/110, 44–50, 92–94, 98, 104, 482/106–108, 139, 148
See application file for complete search history.

(56) References Cited

U.S. PATENT DOCUMENTS

| | | | | |
|---|---|---|---|---|
| 1,229,658 | A * | 6/1917 | Sandow | 482/50 |
| 4,712,792 | A * | 12/1987 | Rogall | 482/23 |
| 6,224,520 | B1 * | 5/2001 | Hsu | 482/107 |
| D540,405 | S * | 4/2007 | Crawford et al. | D21/681 |
| D562,920 | S * | 2/2008 | Hillson | D21/681 |
| D567,311 | S * | 4/2008 | Hillson | D21/681 |
| RE40,430 | E * | 7/2008 | Markham | 119/707 |
| D574,450 | S * | 8/2008 | Januszek | D21/681 |
| 7,887,469 | B1 * | 2/2011 | Chen | 482/108 |
| D663,795 | S * | 7/2012 | Hillson | D21/681 |
| D685,442 | S * | 7/2013 | Childs | D21/681 |

(Continued)

FOREIGN PATENT DOCUMENTS

| | | |
|---|---|---|
| DE | 3526368 | 2/1987 |
| EP | 2021083 | 5/2008 |

(Continued)

OTHER PUBLICATIONS

European Search Report, Mar. 7, 2011.
UK Search Report.

*Primary Examiner* — Loan H Thanh
*Assistant Examiner* — Megan Anderson
(74) *Attorney, Agent, or Firm* — Ice Miller LLP

(57) ABSTRACT

An exercise device, for example a dumbbell or barbell, for weightlifting and other fitness activities, which includes a lifting bar having an axis and opposed axial ends, and a pair of weight sections mounted spaced apart on the respective opposed axial ends of the lifting bar. The lifting bar extends between the spaced apart weight sections defining a handle. Each weight section has an outer circumferential surface, one embodiment in which is a barrelled shape to match and fit in the palm of a user's hand. The circumferential surface of at least one of the weight sections comprises a plurality of grooves, each extending generally circumferentially around only part of the outer circumferential surface of the weight section and spaced substantially axially from an adjacent groove. The sets of grooves define grip areas on the weight section to enable a user to better grip and lift the exercise device.

16 Claims, 11 Drawing Sheets

(56) References Cited

U.S. PATENT DOCUMENTS

| | | | | |
|---|---|---|---|---|
| 8,647,243 | B2 * | 2/2014 | Januszek | 482/108 |
| 2008/0070762 | A1 * | 3/2008 | White | 482/108 |
| 2009/0203506 | A1 * | 8/2009 | Kessler et al. | 482/108 |

FOREIGN PATENT DOCUMENTS

| | | |
|---|---|---|
| EP | 2277604 | 8/2010 |
| FR | 2298346 | 8/1976 |
| KR | 200437442 | 11/2007 |

* cited by examiner

EXERCISE DEVICE FOR WEIGHTLIFTING AND OTHER FITNESS ACTIVITIES

PRIORITY

This Application is a U.S. Nonprovisional Application and claims the priority benefit of pending Great Britain Patent Application 1100066.8, titled "AN EXERCISE DEVICE FOR WEIGHTLIFTING AND OTHER FITNESS ACTIVITIES," filed 5 Jan. 2011, the disclosure of which is incorporated herein by reference.

BACKGROUND OF THE INVENTION

The present invention relates to an exercise device and in particular to a dumbbell or barbell, for weightlifting and other fitness activities. More specifically it relates to the configuration of the weight sections mounted to the lifting handle in such exercise devices.

Conventional dumbbells or barbells comprise a handle bar and weights (heads) mounted on the ends of the bar. The dumbbell is conventionally lifted by the handle bar in order to train specific muscles groups, and/or increase muscle mass. The weights are generally permanently fixed to the bar.

Continuing increase in the popularity of fitness training has created a need to develop new training programmes and classes, to cater for a broad spectrum of training requirements. As such, increasingly varied and adaptable weight training equipment is required to satisfy new training programmes and techniques. In particular it is increasingly common for training programmes and classes to require participants to perform weight lifting operations which differ from the conventional weight lifting techniques for which dumbbells were originally designed. However, space and cost restrictions limit the number of different types of training equipment which a gym or fitness club may purchase and store. Therefore, there is a need for weightlifting equipment which can be used in a variety of ways, to perform a number of different weightlifting operations. In particular it has been identified in accordance with the invention that it would be desirable to provide a more universal weight device which can be gripped and used in a number of different ways in addition to being lifted directly by the central handle bar.

A further problem associated with conventional dumbbells or barbells arises when they are dropped to the floor after use. The impact of the weight heads on the ground, particularly if the weight heads do not impact the ground simultaneously, causes a loosening of the fixing means (either permanent or removable) used to secure the weight heads to the handle which greatly reduces the life cycle of the dumbbells, and can lead to damage of the associated equipment such as racks and benches, and can cause unnecessary wear to the flooring.

U.S. Pat. No. 4,361,324, and Chinese utility model applications CN2167738 and CN 20062045127 disclose dumbbells with rubber outer covers with tread patterns extending circumferentially around the entire circumference of the weight sections. The tread and rubber cover provides some cushioning and in the case of CN 2167738 are described as providing some anti-sliding function. U.S. Pat. No. 5,250,014 also describes a dumbbell with a cushioning plate with a series of projections extending around the entire circumference of the dumbbell. These arrangements can however be improved both in terms of aesthetics, and in providing improved functionality in terms of use by a user and improved cushions and grip, as well as more generally.

In addition, there is a need for an improved dumbbell which will not roll when placed on the floor, yet still retains the qualities required in the above description.

There is therefore also a need for an improved dumbbell which can be used in a wider range of exercises, and which is able to better withstand frequent use, and in particular withstand repeated impact from dropping, and reduces the likelihood of damage to other equipment.

The present invention therefore aims to provide a dumbbell which obviates or mitigates the above described problems and/or which provides improvements generally or an alternative to such existing arrangements.

BRIEF SUMMARY OF THE INVENTION

According to the present invention, there is therefore provided an exercise device as defined in the accompanying claims.

In particular instead of using only the handle to lift the dumbbell, it is proposed that the heads of the dumbbells are modified in such a manner so as to allow the heads themselves to be held and gripped for the purpose of executing a greater variety of exercises. By gripping the heads, the weight distribution of the dumbbells is greatly altered and many more exercises can be carried out using the same device.

To aid the user's grip of the dumbbell head it is also proposed that the head is moulded to the shape of the inside of the palm of the user's hands and slots need to be made at certain positions in the periphery of the head to enhance finger and hand grip. In addition, space needs to be allowed at the end face of the dumbbell head to allow room for comfortable thumb positioning and flats need to be inserted on the inner face of the dumbbell heads to allow for alternative finger grips when lifting the dumbbells from a vertical position on the floor.

The plurality of slots are disposed only in discrete circumferential regions of the periphery of the weight section. Providing slots and a pattern only in a discrete circumferential region of the circumference of the weight section better defines, both visually and functionally, a particular grip region for a user to grip and hold the weight section and dumbbell for certain exercises. The flats on the inner axial end faces of the dumbbell heads allow additional finger grips to hold the head firmly when performing exercises with the dumbbell.

The slots and the curved shape of the dumbbell head are configured to form a grip portion for a user to grip and hold the weight section within the palm of the user's hands. The thumb/finger recesses at each end of the head further defines a grip portion for holding the weight section, with a user's thumbs being able to fit into the recesses. The flats formed on the inner surfaces of the dumbbell heads provide alternative finger grips providing a variety of gripping points so extending the range of exercises that can be performed with the device. This improves a user's grip of the weight section, as well as more clearly indicating where and how a user can hold the weight section and dumbbell.

It is also proposed that the weight heads of the dumbbell have a curved shape. This can be contrasted with the sharp corners of conventional dumbbells and spreads the load over a larger curved area of the dumbbell head as in a rubber ball rather than impacting on sharp corners.

The curved shape and ends of the dumbbell heads also improves the impact absorption properties of the outer skin by greater distribution of the impacted area and hence of the weight section and exercise device, thereby providing a "softer" impact in the area of the dumbbell head that is most susceptible to impact in use. This softer impact reduces jarring of the weight section, and of the fixings between the weight section and the handle of the exercise device to which the weight section is mounted, thereby mitigating the risk of loosening of the weight heads, mitigating damage to the weight section, and reducing damage to the exercise device, for example dumbbell generally, and to other equipment.

It is also proposed that the dumbbell however has a flat surface incorporated into the shape of the head which will prevent the dumbbell from rolling on the floor and will allow the dumbbell to be used for exercises such as press-ups.

The flattened peripheral section of the dumbbell head varies the outer circumference surface of the dumbbell circumferential around the dumbbell such that the dumbbell will tend to rest in a particular circumferential position when placed on the ground. This assists in preventing the dumbbell from rolling when placed on the ground. Furthermore this also provides the weight sections with increased surface grip preventing the dumbbells from rolling or from slipping against the ground when a user places their weight on them, for example to perform push-ups.

The weight section may comprise an inner weight section comprising a cast metal weight. The outer skin and resilient projections may be formed from polyurethane or rubber or any similar material. The slots, thumb-grip and flattened section may be integrally formed with and from the outer skin. This allows the recess to be most easily formed with a simple cast inner weight section core which does not include such a recess. Integrally forming the grip slots and other features from the outer skin also enables these important features to be formed in the same manufacturing step as the skin, thereby simplifying manufacture. In addition, the features are thus securely connected to the outer skin. In addition it provides a relatively flexible and soft shoulder area surrounding the recesses on the outer end faces improving grip and comfort to a user.

In an embodiment of the invention there is provided an exercise device, for example a dumbbell or barbell, for weightlifting and other fitness activities. The device comprises a lifting bar having an axis and opposed axial ends, and a pair of weight sections mounted spaced apart on the respective opposed axial ends of the lifting bar with the lifting bar extending between the spaced apart weight sections. Each weight section has an outer circumferential surface, an inner axial end face facing the inner axial end face of the other weight section mounted on the opposite end of the lifting bar, and an outer axial end face. The circumferential surface of at least one of the weight sections comprises a plurality of grooves each extending generally circumferentially around only part of the outer circumferential surface of the weight section and spaced substantially axially from an adjacent groove axially along the outer circumferential surface of the weight section.

The grooves are preferably sized and spaced to substantially match a typical user's finger.

At least one of the grooves preferably extends a different circumferential distance around the weight section to at least one of the other grooves.

Preferably the plurality of grooves comprise two sets of grooves disposed on substantially diametrically opposite sides of outer circumferential surface of the weight section. Furthermore each set of grooves may comprise three or more spaced apart grooves in each set. A central groove of the three spaced apart grooves in each set preferably extends circumferentially further than the adjacent grooves on either side of the central groove.

Each weight section may preferably have a barrelled or curved circumferential outer surface having a central portion at greater radius from lifting bar than axial inner and outer end portions. The outer circumferential surface of each weight section may be curved to match an inner palm surface of a typical user's hand.

Preferably the outer circumferential surface includes a substantially flat portion.

At least one section of the inner axial end face of at least one of the weight sections is preferably recessed from a remainder portion of the inner axial end face. Moreover the inner axial end face of at least one of the weight sections preferably includes two recessed sections disposed on diametrically opposite sides of the inner axial end face.

An outer axial end of at least one of the weight sections may be recessed from a remainder portion of the outer axial end face.

Preferably the weight sections comprise an inner weight section about which is moulded an outer skin. The outer skin may comprise a polyurethane or rubber skin. The grooves are preferably integrally formed within the outer skin.

BRIEF DESCRIPTION OF THE DRAWINGS

The present invention will now be described by way of example only, and with reference to the following illustrated figures in which.

DETAILED DESCRIPTION OF THE INVENTION

Figure 1:
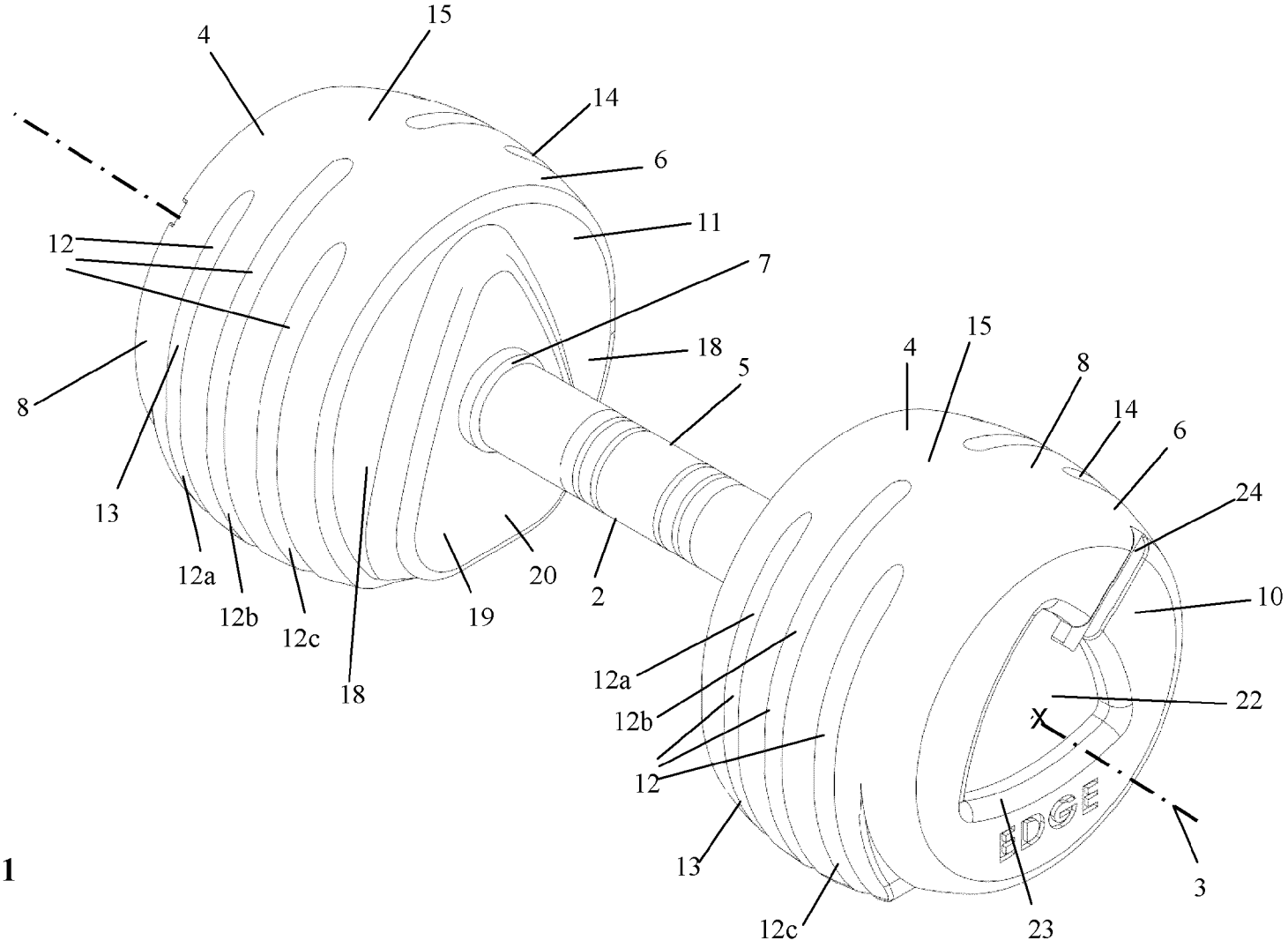
FIG. 1 is a perspective view of a dumbbell according to an embodiment of the invention.

Referring to FIG. 1, a dumbbell 1 comprises a lifting bar 2 having an axis 3. First and second weight sections 4 are mounted spaced apart on the respective opposed axial ends of the lifting bar 2. The lifting bar 2 extends between the spaced apart weights sections 2. The bar 2 comprises a central handle portion 5, configured to enable a user to conventionally grip the bar 2 to lift the weight sections 4 and dumbbell 1 conventionally. The bar 2 is preferably formed from stainless or carbon steel which may be plated or covered in material such as rubber or polyurethane, but may be made from man-made material such as polyurethane to improve grip.

Figure 10:
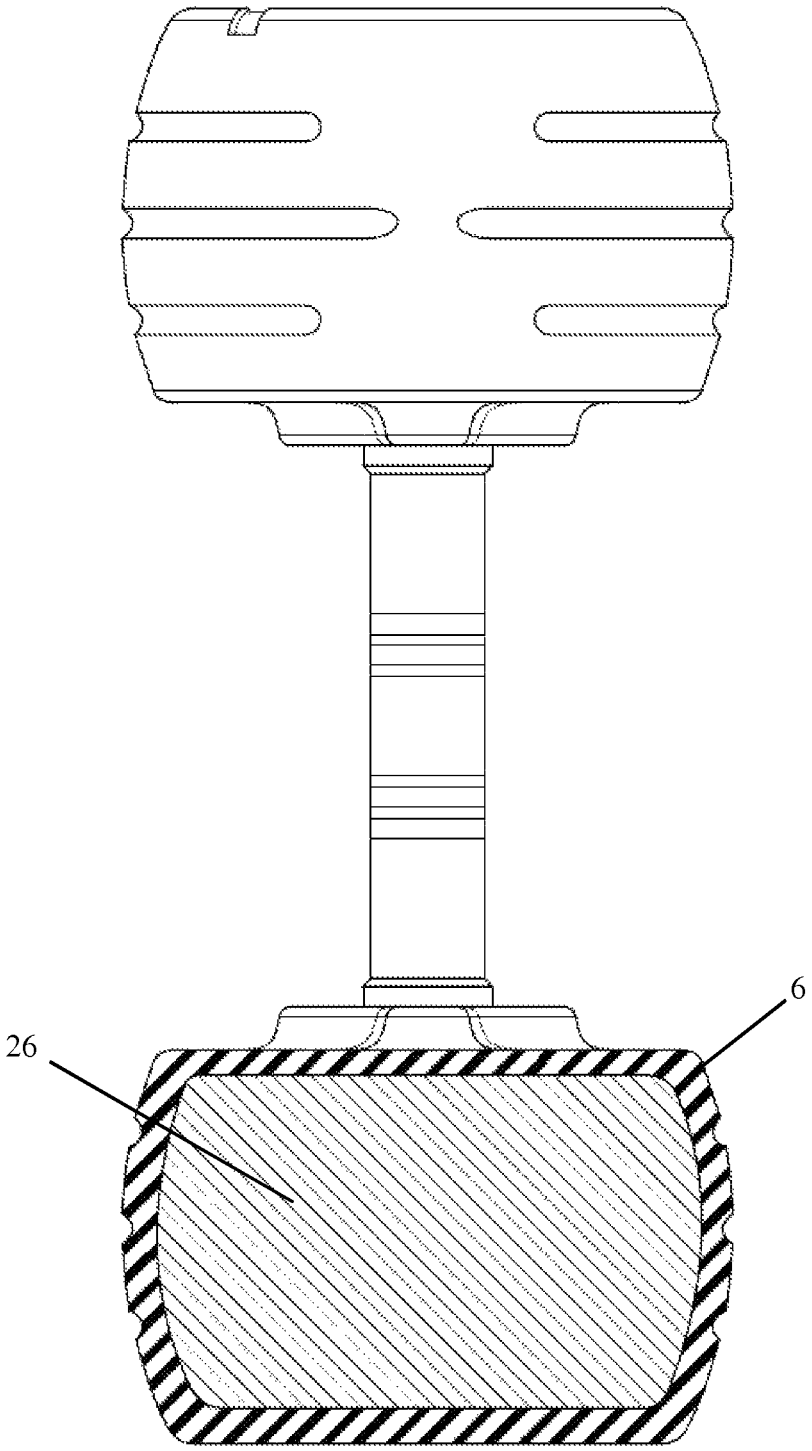
FIG. 10 is a top view of the dumbbell shown in FIG. 1 and a cross sectional view of one of the weight sections.
Figure 11:
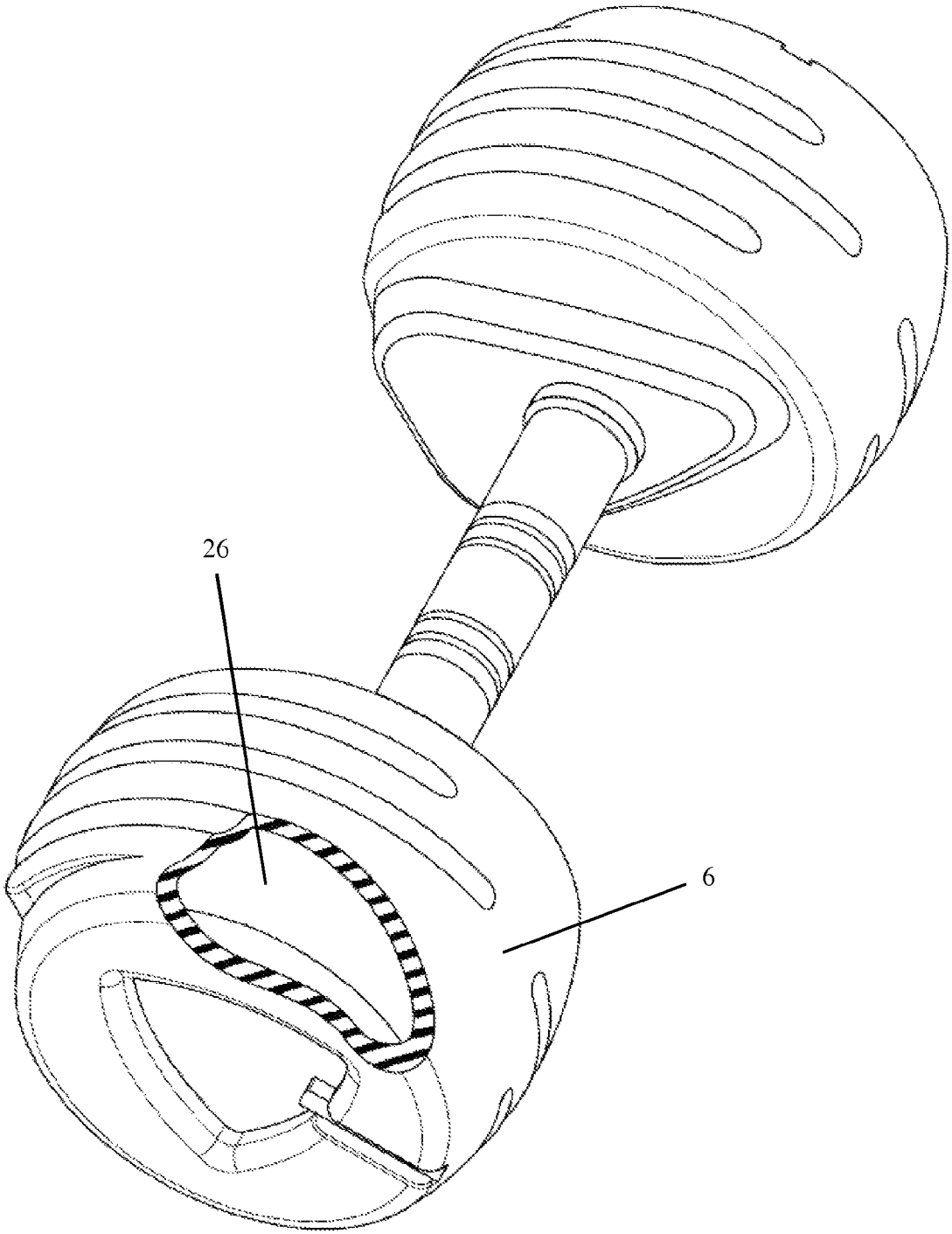
FIG. 11 is a perspective view of the dumbbell shown in FIG. 1 with an illustrative cut out of one of the weight sections.

The weight sections 4 preferably comprise an inner weight section 26 formed from cast iron, although any other suitable material may be used. An outer skin 6 of polyurethane or rubber material is formed about the inner weight section 26. Specifically, as shown in FIGS. 10 and 11, the outer skin 6 is moulded about the inner weight section 26. As cast iron typically comprises a low quality surface finish, the outer skin 6 provides the weight section 4 with an improved visual appearance. In addition, the resilient and compressible material properties of the polyurethane outer skin 6 act to protect the inner weight section 26 from damage, and provide limited impact absorption. In addition, coating the inner weight section 26 with an outer skin 6 protects the cast iron from corrosion, and mechanical damage.

The weight sections 4 are generally substantially cylindrical in shape having a preferably centrally located mounting bore 7 configured to receive an end of the bar 2, and mount the weight sections 4 coaxially with an axis 3 of the bar 2. The mounting bore 7 may be formed in the inner weight section 26 during the casting processing or may be machined after casting. Alternatively, and preferably the inner weight section 26 may be cast about a collar (not shown) defining the inner bore 7. The inner bore 7 is toleranced to provide an interference fit, to prevent rattle between the bar 2 and the inner weight section 26. The weight sections 4 are welded into position on the ends of the bar or attached in other known ways.

Each weight section 4 has an outer circumferential surface 8 extending around the weight section radially spaced from the axis 3 having an axial width in a direction parallel to the axis 3. Each weight section 4 furthermore has two generally opposed axial end faces 10,11 comprising an outer axial end face 10 and an inner axial end face 11. The inner axial end faces 11 are adjacent the handle portion 5 and faces the corresponding inner axial end face 11 of the other weight section 4 when the weight sections 4 are mounted upon the lifting bar 5. The axial end faces 10, 11 extend generally perpendicular to the axis 3.

As shown in the figures the outer circumferential peripheral surface 8 of the weight sections 4 include a plurality of grooves 12 (or slots or recesses) which are formed in the outer circumferential surface 8 of the weight section. The grooves 12 comprise elongate channels formed in the outer circumferential surface 8 of the weight section extending in a generally circumferential direction. The grooves 12 however only extend partway around the circumferential surface 8 and weight section 4. Each of the individual grooves 12 are located at a respective axial distance across the width of the weight section 4 with the grooves 12 preferably parallel to each other spaced axially and axially aligned with respect to the weight section 4. In other embodiments they may however extend around the circumference at an angle to an axial plane and/or at angles to each other. In particular the grooves 12 are arranged in two opposing sets 13,14 disposed on diametrically opposite sides of circumferential surface 8 of the weight section 4, with there being smooth, non-grooved region 15,16, in this case diametrically opposed, between the two sets of grooves 13,14. While preferably the regions between the sets 13,14 of grooves 12 are smooth regions, in other embodiments these regions may be provided with alternate grooves or patterns and it is simply required that the individual grooves 12 do not extend completely around the circumference of the weight section 14. In a preferred embodiment, as shown, each set of grooves 13,14, and the grooves 12 extend approximately around one quarter to one third of the distance around the circumference of the weight section 14.

The grooves or slots 12 are formed about the circumferential surface 8 to increase grip in use by increasing surface roughness. The shape and position of the grooves 12 are such that they also assist the user to grip the dumbbell weight head 4. The sets 13,14 of grooves 12 also define, both visually and functionally, a particular grip region for a user to grip and hold the weight section 4 and dumbbell 1 for certain exercises. Examples of such alternative grips enabled and which can be used by a user with the dumbbell 1 are shown in FIGS. 6 to 9. It will however be appreciated that other grips may also be utilised. This increases the functionality of the dumbbell 1 by enabling it to be more effectively and safely gripped by the weight sections 4, and therefore used to perform an increased and varied number of weightlifting and exercise operations. In particular, grasping the dumbbell 1 by the weight sections 4 requires an alternative grip, and therefore forces the user to lift the dumbbell 1 in a different way, using different muscle groups.

Each of the sets 13,14 of grooves 12 comprise three individual grooves 12*a*, 12*b*, 12*c* disposed parallel and spaced apart from each other with a central groove 12*b* disposed generally in the centre of the axial width of the circumferential surface 8 and the other two side grooves 12*a*,12*c* disposed either side of it. The central groove 12*c* preferably extends slightly further than the side grooves 12*a*, 12*c* so as to easily accommodate a user's slightly longer index finger when gripping the weight as for example shown in FIGS. 6 and 7, and with these other two fingers easily falling within the adjacent grooves. The grooves are spread apart from each other as it is generally corresponding to the spacing of a typical user's fingers.

Each of the groves or slots 12 has a curved radiused profile preferably shaped to readily accommodate a typical user's finger and for example has a width in the region of 10 to 20 mm and a resulting depth of in the region of 5 to 10 mm. In other embodiments however the grooves 12 may be smaller and narrower simply providing a roughened area and recess portions to increase the grip in the specific regions. The grooves 12 are also axially spaced apart with the centres of the grooves 12*a*,12*b*,12*c* typically between 15 to 40 mm apart.

Figure 2:
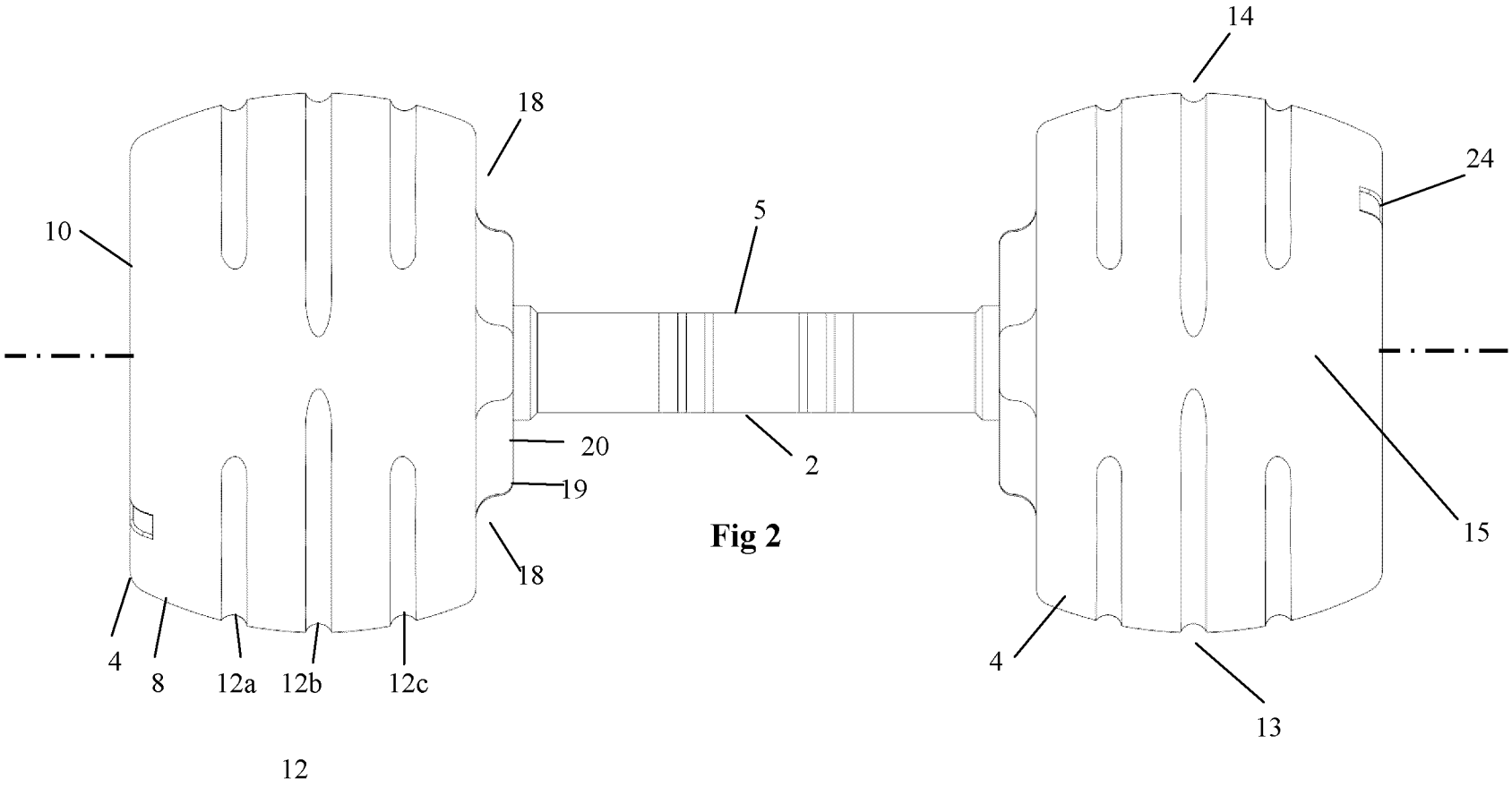
FIG. 2 is a top view of the dumbbell shown in FIG. 1.
Figure 3:
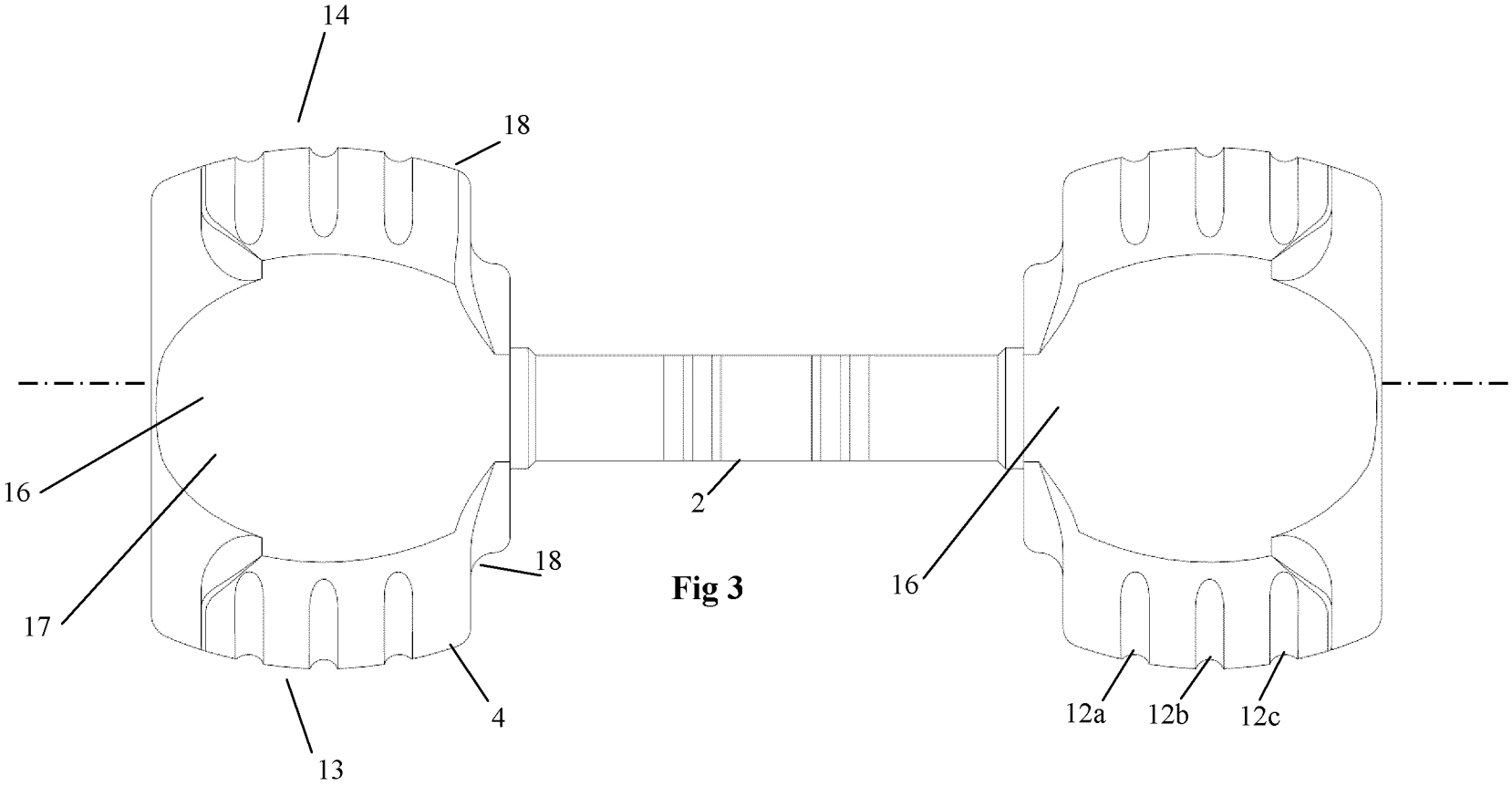
FIG. 3 is a bottom view of the dumbbell shown in FIG. 1.
Figure 4:
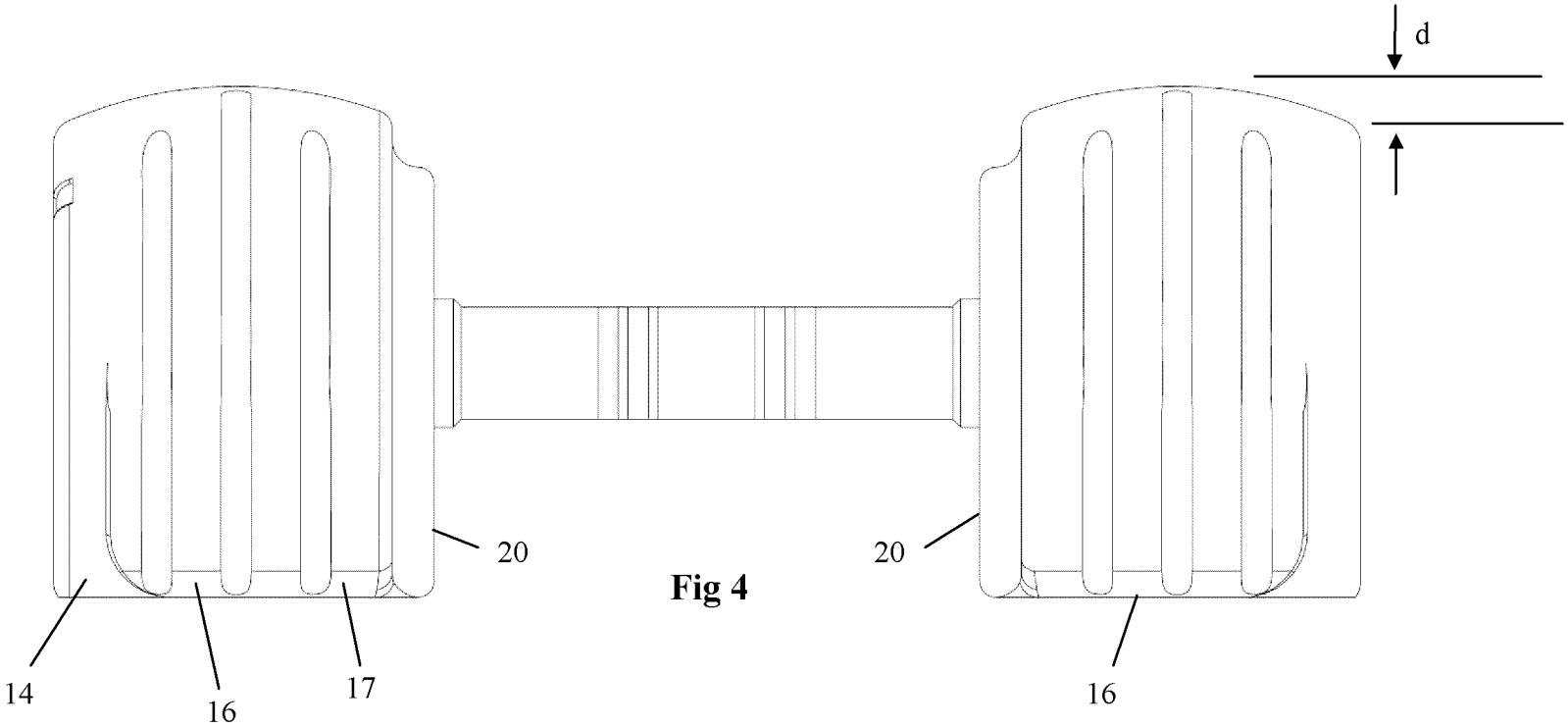
FIG. 4 is a front view of the dumbbell shown in FIG. 1.
Figure 5:
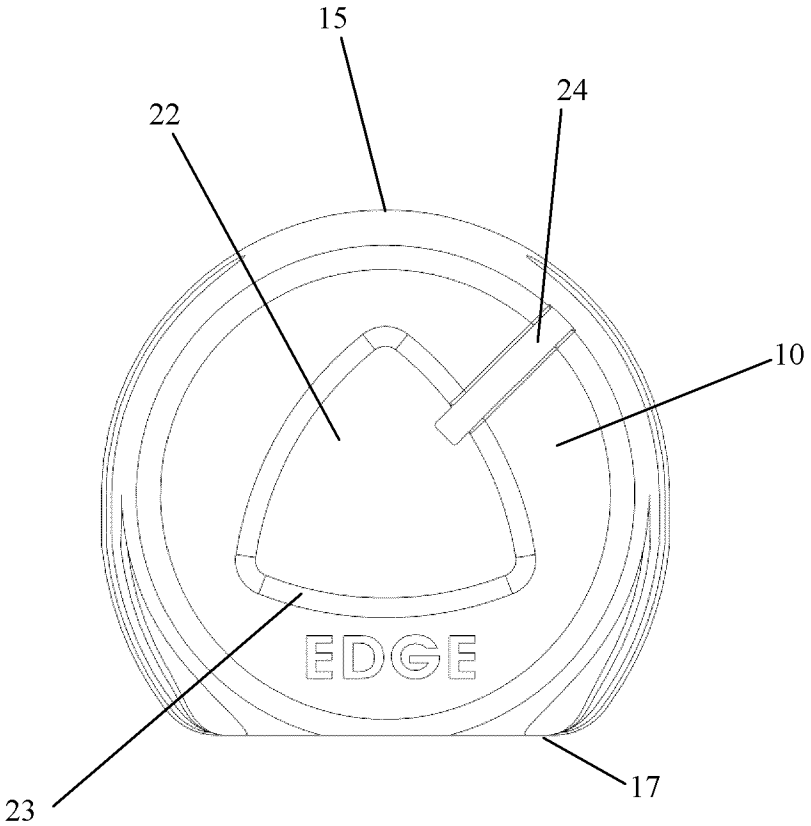
FIG. 5 is an axial end view of the dumbbell shown in FIG. 1.
Figure 6:
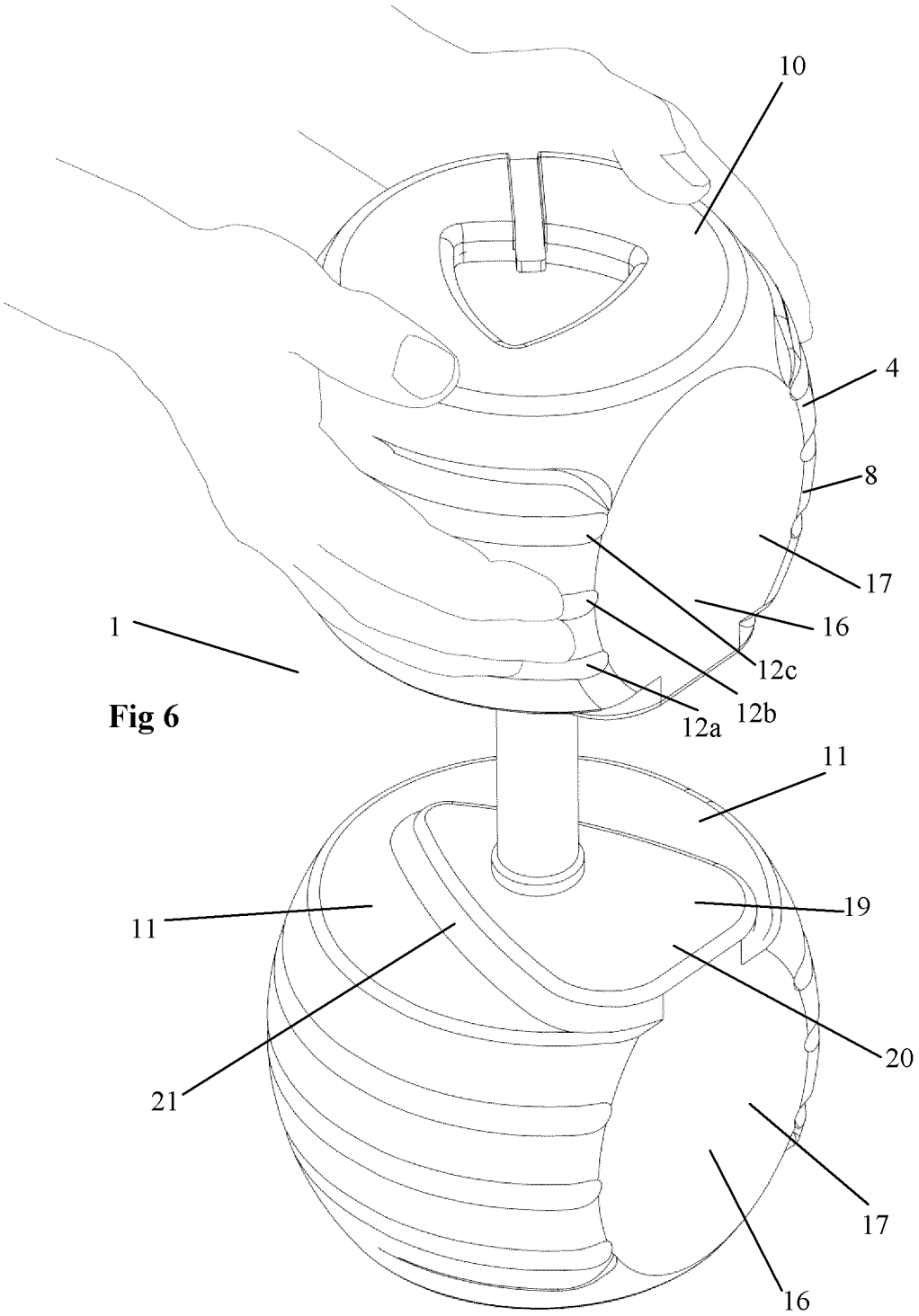
FIG. 6 is a schematic perspective illustration of a user holding the weight section of the dumbbell shown in FIG. 1 in a first vertical manner.
Figure 7:
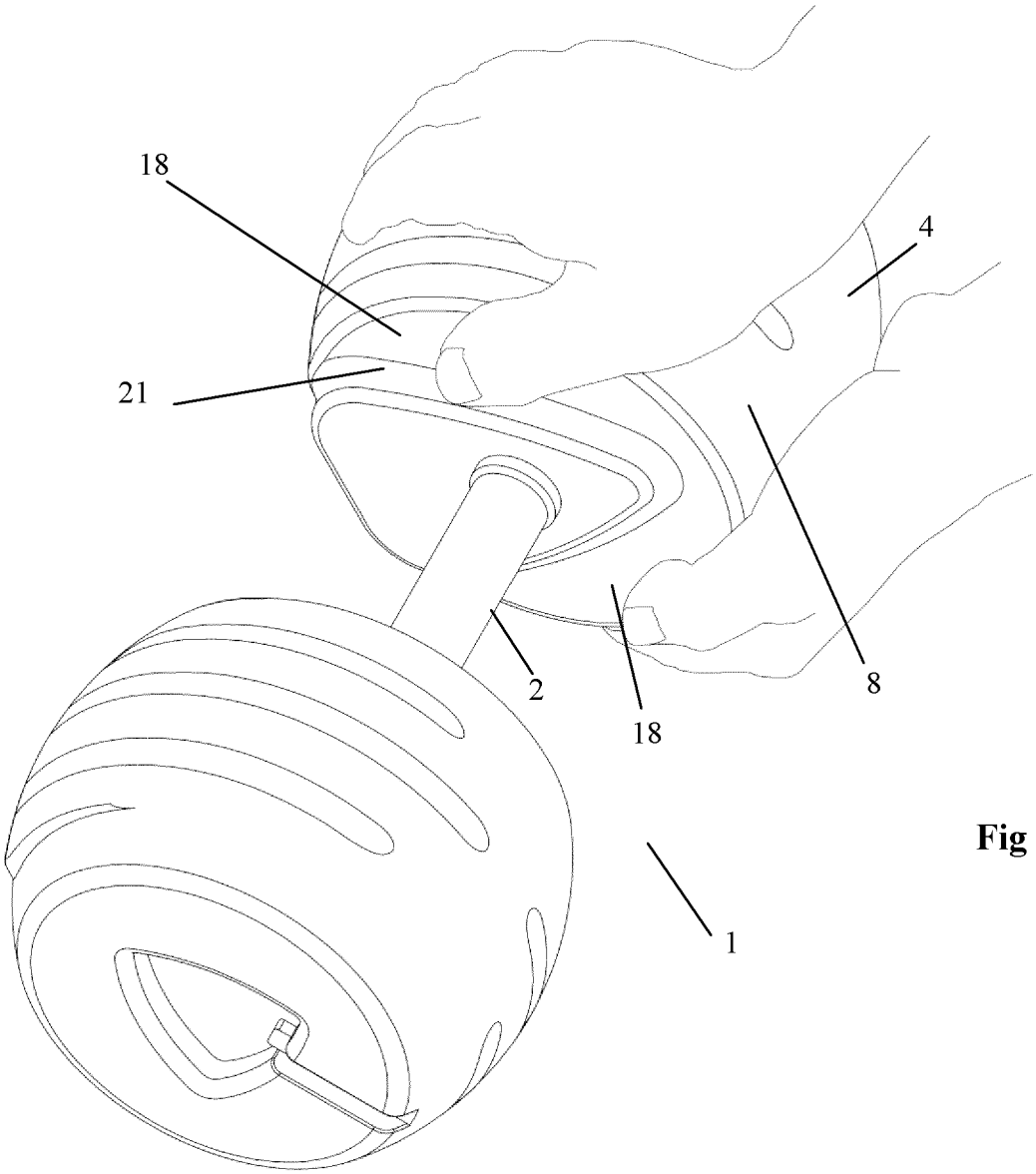
FIG. 7 is a schematic perspective illustration of a user holding the weight section of the dumbbell shown in FIG. 1 in a second horizontal manner.
Figure 8:
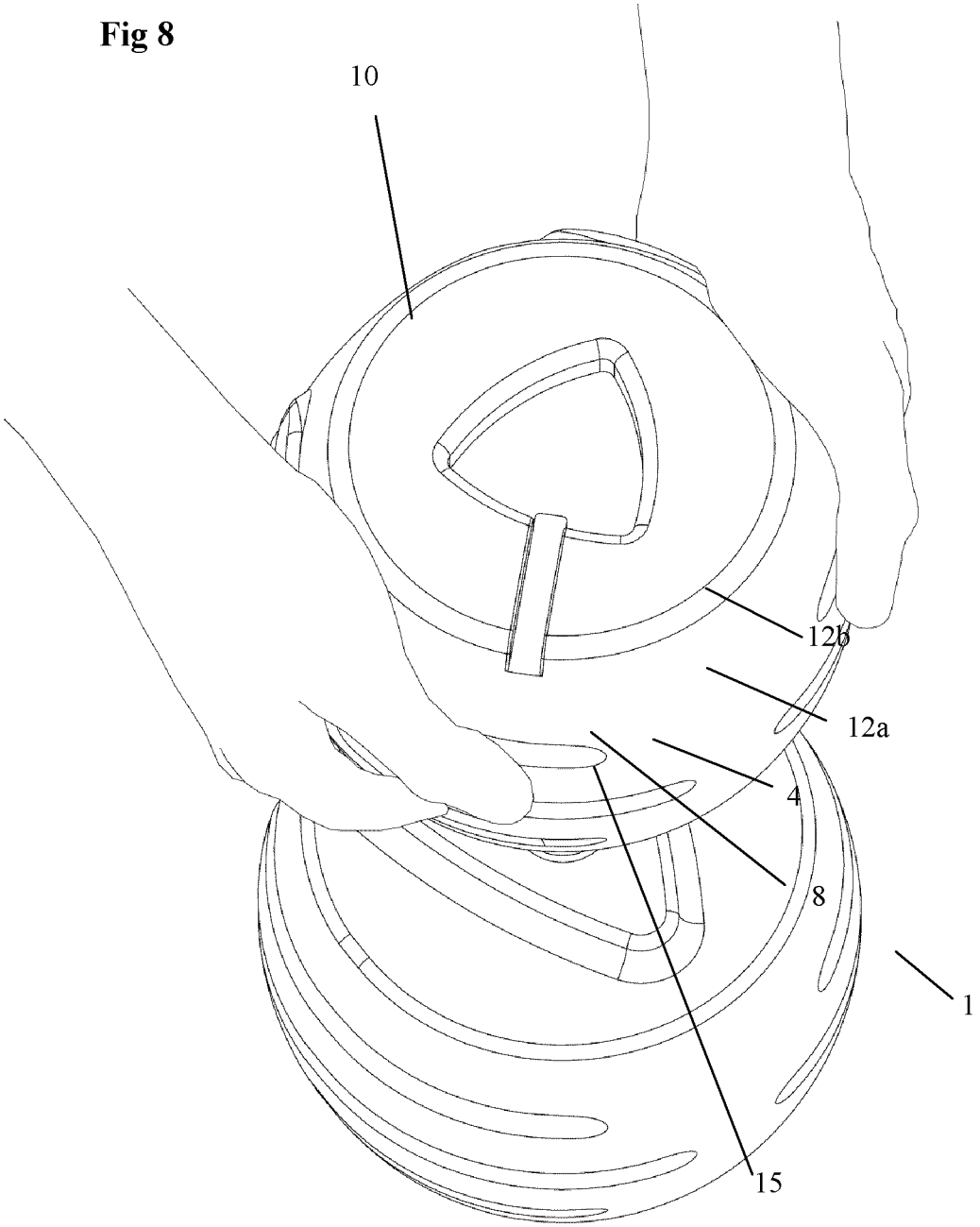
FIG. 8 is a schematic perspective illustration of a user holding the weight section of the dumbbell shown in FIG. 1 in a third vertical manner.
Figure 9:
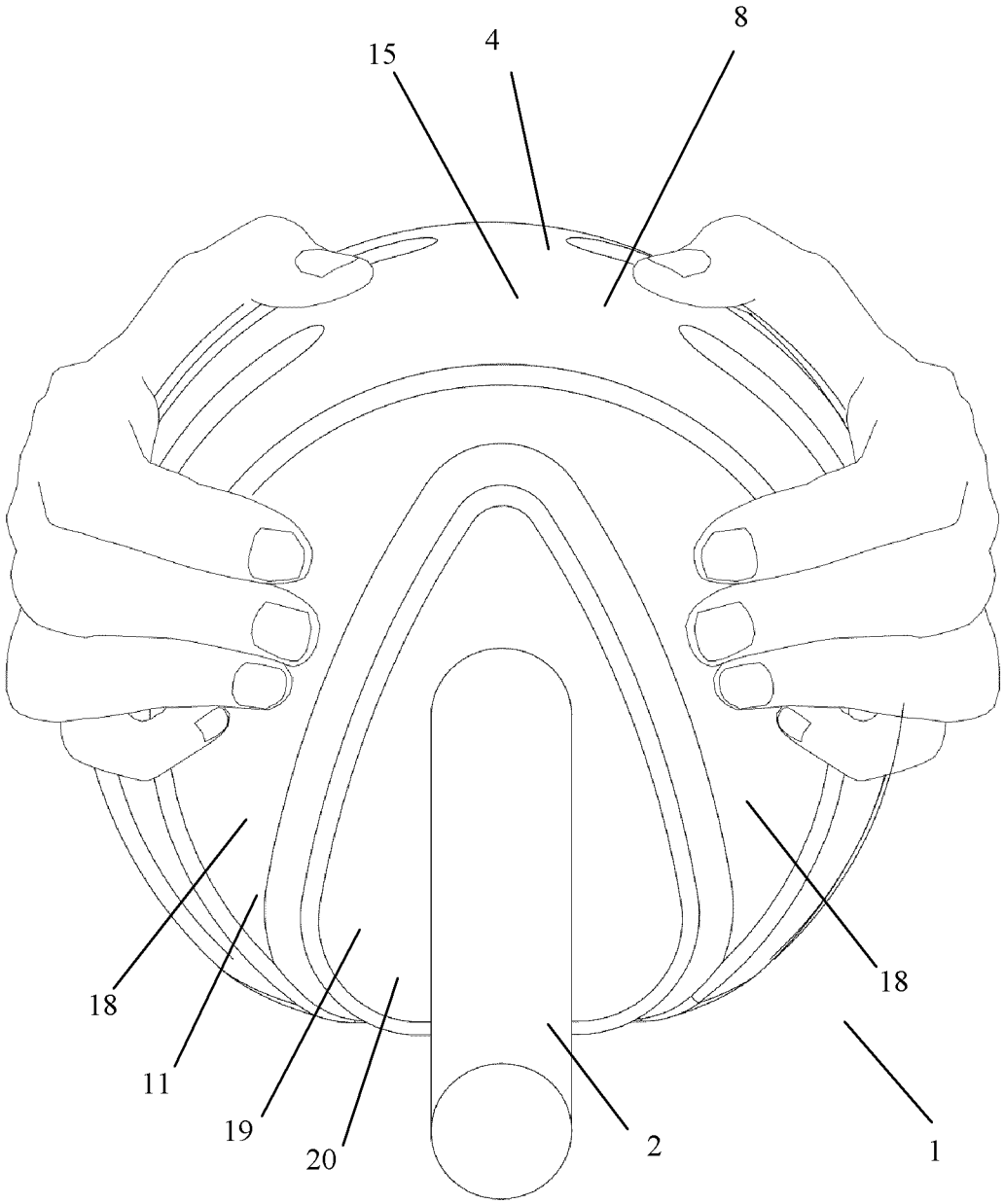
FIG. 9 is a schematic axial part perspective illustration of a user holding the weight section of the dumbbell shown in FIG. 1 in a fourth manner.

The outer circumferential surface 8 of each of the weight sections 4 is also preferably curved in a generally axial direction as more clearly shown in FIGS. 2 to 4 with the outer peripheral surface 8 and weight sections 4 having a barrelled barrel shaped outer surface. The profile of the peripheral surface 8 of the weight section 4 is dimensioned to comfortably fit within a user's hand when gripping the weight head 4 on the other side as for example shown in FIGS. 6 and 7 and makes it more comfortable for a user to grasp the weight head 4. The projecting central portion also improves a user's grip of the weight head 4 by providing a central rib which assists in preventing the weight head 4 from slipping from the user's hand when for example being held as shown in FIG. 6 with the central 'bulge' fits within a user's cupped hands. In particular the central portion of the outer circumferential surface 8 of each weight head 4 is generally at a greater radius from the axis 3 than axial end portions of the circumferential outer surface 8 with the central portion projecting a distance d for example 5 mm further radially outward.

The outer circumferential surface 8 of the weight heads 4 also preferably further includes a flattened section 17 such that the weight section 4 is not entirely symmetrical about the axis 3. This flattened section 17 preferably corresponds to one of the sections 16 between the sets of grooves 13,14 and preferably extends across the entire axial width of the outer circumferential surface 8 of the weight section 4. This flattened section 17 forms a base of the dumbbell 1 with both weight heads 4 being aligned such that the flattened sections 17 are aligned and allow the dumbbell 1 to be placed stably on the ground without rolling. The flattened section 17 also provides increased traction between the dumbbell 1 and the floor when the dumbbell 1 is placed on the floor and so enables a user to support their weight on the dumbbell 1 and bar 2 for example to perform push ups while limiting the risk of the dumbbell 1 from slipping underneath them. This allows the dumbbell 1 to be used in yet further exercises with the dumbbell 1 handle 5 providing a handle on the floor that can be gripped.

The respective inner axial end faces of the weight sections 4 include two diametrically opposed recess sections 18 which are axially set back from the end 19 of the axial end face 11. The recess portions 18 in this embodiment comprise chordal sections of the axial end of the weight head 4, and are arranged at an angle to each other and leaving a central triangular portion 20 therebetween. The recessed sections 18 are preferably circumferentially aligned with the respective sets 13,14 of grooves 12 with a base of the triangular section 20 aligned with the flattened section 17 of the weight heads 4. The recess sections 18 provide as for example shown in FIG. 7 suitable space for a user's thumbs to be located when gripping the weight head 4. A shoulder portion 21 along the edge of the triangle section 20 and recessed portion 18 also provides a lip against which a user's thumb can rest. The recesses 18 also provide sufficient room for a user's fingers to be located when gripping the weight head 4 as for example shown in FIG. 9. It will be appreciated that in other embodiments different shapes of recesses 18 in the axial inner end face 11 could be provided to similarly accommodate a user's thumb or finger when gripping the dumbbell weight head 4.

The outer axial end face 10 of the weight sections 4 preferably includes a central recessed portion 22. In this embodiment this recessed section 22 is also generally triangular shape aligned with the triangular section 20 on the inner axial end face 11 and flattened region 17 on the bottom of the weight head 4. This recessed portion 22 defines a shoulder lip 23 in the outer axial end face 10 which a user can furthermore grip improving the grip of the weight head 4 with the user's thumb or finger resting in the recess 22 and against this shoulder 23. This again further improves the user's ability to grip the weight head 4 and the end of the dumbbell 1. Again the exact configuration of the recess 22 may be varied in other alternate embodiments. The outer axial end face 10 also includes a generally radially extending slot 24 which is preferably sized to receive a user's finger or hand and provides a further location and feature enabling a user to grip the end of the weight head 4.

The dumbbell 1, and in particular outer profiling and features of the weight head 4 both individually and in particular in combination all provide a dumbbell 1 which may be gripped by a user in a number of different ways, and accordingly used in a number and wider variety of exercises than is possible with a conventional dumbbell, with in particular these features allowing the weight heads 4 of the dumbbell 1 to be more safe and better gripped and held by a user in a safe manner.

The barrelling of the outer profile of the weight heads 4 provides the weight heads 4 with a curved and rounded profile without any sharp edging which reduces impact damage if and when the dumbbell 1 is dropped on a floor and/or against other objects.

The grooves/slots 12 and recesses 18,22 within the outer peripheral surface of the weight heads 4 are preferably all formed within the moulded outer skin 6 of the weight head 4 and are integral therewith.

The outer skin 6 is preferably formed about the inner weight section 26 by a moulding operation using a mould (not shown) into which the inner weight section 26 is placed with the mould surrounding the inner weight section 26. The mould defines a mould cavity between the inner weight section 26 and an inner mould surface corresponding to the outer skin 6. A material, such as polyurethane, is then injected into the mould cavity, where it forms about the inner weight section 26. In this way an outer skin 6 having the plurality of grooves slots 12 is formed about and moulded onto the inner weight section 26.

The mould may in particular comprise two mould sections, or mould halves. The two mould halves may be further fitted into an outer mould section to hold them together during moulding. The mould halves each comprise an inner surface having a configuration including projections shaped to define the grooves/slots 12. The mould halves are split along a longitudinal plane passing though the axis of the weight section 4. The mould halves can thereby be separated and the mould split open to allow the weight head 4 with moulded outer covering 6 to be removed.

It will be appreciated that in further embodiments, various further modifications to this specific arrangement described above and shown in drawings may be made. For example the weight sections 4 in this embodiment are generally cylindrical, excepting the barrelling and localised flat portion 17, and have a generally circular outer circumference. In other embodiments the weight sections 4 may have other shapes while still having a generally circumferential surface and central axis. Furthermore the weight sections 4, bar 2 upon which the weight sections 4 are mounted do not need to be coaxial with the central axis 3. While each of the weight sections 4 are preferably substantially identical in other embodiments they may be different and for example only one of the weight sections 4 may include the grooves 12.

The invention claimed is:

1. An exercise device for weightlifting and other fitness activities comprising:

a lifting bar having an axis and opposed axial ends; and a pair of weight sections mounted spaced apart on the respective opposed axial ends of the lifting bar with the lifting bar extending between the spaced apart weight sections, each weight section having an outer circumferential surface, an inner axial end face facing the inner axial end face of the other weight section mounted on the opposite end of the lifting bar, and an outer axial end face;

wherein the circumferential surface of at least one of the weight sections comprises a plurality of grooves each extending generally circumferentially around only part of the outer circumferential surface of the weight section and spaced substantially axially from an adjacent groove axially along the outer circumferential surface of the weight section the plurality of grooves being sized and spaced to substantially match a human's finger and/or finger imprint;

wherein the weight sections comprise a solid inner weight section comprised of a metal and a resilient outer skin layer that is moulded about an outer circumferential surface of the solid inner weight section, and the plurality of grooves are integrally formed within the outer skin.

2. An exercise device of claim 1 wherein at least one of the plurality of grooves extends a different circumferential distance around the weight section to at least one other of the plurality of grooves.

3. An exercise device of claim 1 wherein the plurality of grooves comprise two sets of grooves disposed on substantially diametrically opposite sides of the outer circumferential surface of the weight section.

4. An exercise device of claim 3 wherein each set of grooves comprises three or more spaced apart grooves in each set.

5. An exercise device of claim 4 wherein a central groove of the three or more spaced apart grooves in each set extends circumferentially further than the adjacent grooves on either side of the central groove.

6. An exercise device of claim 1 wherein the pair of weight sections has a substantially barrelled or curved circumferential outer surface having an central portion at greater radius from the lifting bar than the axial inner and outer end portions.

7. An exercise device of claim 1 wherein the outer circumferential surface of each weight section is curved to match an inner palm surface of a human's hand.

8. An exercise device of claim 1 wherein the outer circumferential surface includes a substantially flat portion.

9. An exercise device of claim 1 wherein at least one section of the inner axial end face of at least one of the weight sections is recessed from a remainder portion of the inner axial end face.

10. An exercise device of claim 9 wherein the inner axial end face of at least one of the weight section includes two recessed sections disposed on diametrically opposite sides of the inner axial end face.

11. An exercise device of claim 1 wherein the outer axial end of at least one of the weight sections is recessed from a remainder portion of the outer axial end face.

12. An exercise device of claim 1 wherein the outer skin comprises a polyurethane or rubber skin.

13. An exercise device of claim 1 wherein the weight sections comprise a centrally located mounting bore for mounting the weight sections spaced apart on the respective opposed axial ends of the lifting bar.

14. An exercise device of claim 1 wherein the plurality of grooves extend approximately one quarter to one third of the distance around the outer circumferential surface of the weight section.

15. An exercise device for weightlifting and other fitness activities comprising:

a lifting bar having an axis and opposed axial ends; and a pair of weight sections mounted spaced apart on the respective opposed axial ends of the lifting bar with the lifting bar extending between the spaced apart weight sections, each weight section having an outer circumferential surface, an inner axial end face facing the inner axial end face of the other weight section mounted on the opposite end of the lifting bar, an outer axial end face, and an inner weight section comprised of a non-plastic material;

wherein the circumferential surface of at least one of the weight sections is curved to match an inner palm surface of a human's hand, and comprises a plurality of grooves each extending generally circumferentially around only part of the outer circumferential surface of the weight section and spaced substantially axially from an adjacent groove axially along the outer circumferential surface of the weight section;

wherein the plurality of grooves are sized and spaced to substantially match a human's finger and/or finger imprint; and wherein an outer skin layer is moulded about an outer circumferential surface of the inner weight sections, and the plurality of grooves are integrally formed within the outer skin.

16. An exercise device of claim 15 wherein the outer circumferential surface includes a substantially flat portion.

* * * * *